US005647342A

United States Patent [19]

Jamieson et al.

[11] Patent Number: 5,647,342

[45] Date of Patent: Jul. 15, 1997

[54] GAS OPERATED FIREPLACE ASSEMBLY

[75] Inventors: Donald R. Jamieson, Oakville; Peter G. VanderPlaat, Mississauga; Jimmy R. Poe, Oakville; Richard T. Holman, Mississauga; Claudia M. Ramos, Etobicoke, all of Canada

[73] Assignee: Lennox Industries Inc., Dallas, Tex.

[21] Appl. No.: 230,607

[22] Filed: Apr. 21, 1994

[51] Int. Cl.[6] ..... F24C 3/00

[52] U.S. Cl. ..... 126/512; 126/515; 126/531

[58] Field of Search ..... 126/515, 512, 126/500, 531, 528, 529; 431/125

[56] References Cited

U.S. PATENT DOCUMENTS

| | | | |
|---|---|---|---|
| 471,575 | 3/1892 | Shaw . | |
| 801,244 | 10/1905 | Hughes . | |
| 2,131,763 | 10/1938 | Sroat | 126/531 X |
| 2,225,203 | 12/1940 | Barnes . | |
| 3,291,116 | 12/1966 | Brooks . | |
| 3,614,949 | 10/1971 | Goodgion . | |
| 4,015,581 | 4/1977 | Martenson . | |
| 4,519,376 | 5/1985 | Schoeff et al. . | |
| 4,700,687 | 10/1987 | Bailey et al. . | |
| 4,787,365 | 11/1988 | Coleman . | |
| 4,793,322 | 12/1988 | Shimek et al. | 126/512 X |
| 4,852,548 | 8/1989 | Shimek et al. . | |
| 4,909,227 | 3/1990 | Rieger . | |
| 4,976,253 | 12/1990 | Beal et al. . | |
| 5,000,162 | 3/1991 | Shinek et al. | 126/512 |
| 5,072,719 | 12/1991 | Burger et al. . | |
| 5,076,254 | 12/1991 | Shimek et al. . | |
| 5,081,981 | 1/1992 | Beal | 126/512 X |
| 5,092,313 | 3/1992 | Blackboun et al. | 126/531 X |
| 5,230,086 | 7/1993 | Beal et al. . | |
| 5,249,567 | 10/1993 | Maitland et al. . | |
| 5,267,552 | 12/1993 | Squines | 126/512 |
| 5,299,558 | 4/1994 | Binzer . | |
| 5,307,801 | 5/1994 | Schroeter et al. | 126/515 |
| 5,320,086 | 6/1994 | Beal et al. | 126/576 X |
| 5,429,495 | 7/1995 | Shimek et al. | 126/512 X |

FOREIGN PATENT DOCUMENTS

| | | | |
|---|---|---|---|
| 2073727 | 1/1993 | Canada . | |
| 0307038 | 5/1989 | European Pat. Off. | 126/523 |
| 2519998 | 11/1975 | Germany | 126/528 |
| 847141 | 9/1960 | United Kingdom . | |
| 2082761 | 3/1982 | United Kingdom . | |
| 2180333 | 3/1987 | United Kingdom . | |

*Primary Examiner*—Carl D. Price
*Attorney, Agent, or Firm*—W. Kirk McCord

[57] ABSTRACT

A gas operated fireplace assembly is comprised of a plurality of modular components, including a casing, firebox, burner module and combustion air-intake module. The casing has an open front and is positionable in an enclosure adjacent a room with the open front facing the room. The firebox is insertable into the casing through the open front thereof and is removably mounted within the casing such that the firebox is removable therefrom without having to remove the casing from the enclosure. The casing can be installed separate from the other modules (e.g., during the "rough-in" phase of construction) and the other modules installed at a later time. Both the casing and firebox have respective top panels which are sloped at approximately 25° to accommodate both a vertical and a horizontal flue configuration while maintaining the front-to-back depth of the fireplace assembly within acceptable limits. The air-intake module includes an air-intake manifold removably mountable within the casing in fluid communication with an external combustion air source and a plurality of cylindrical tubes communicating between the manifold and the firebox for introducing combustion air into the firebox. Both the manifold and tubes are located in an air wipe between the firebox and casing. The individual fireplace modules may be assembled into a unitary fireplace at a manufacturing facility and shipped to an installation site. Alternatively, the modules may be shipped as a kit and assembled at the installation site.

7 Claims, 9 Drawing Sheets

GAS OPERATED FIREPLACE ASSEMBLY

FIELD OF THE INVENTION

This invention relates generally to gas operated fireplaces with sealed combustion chambers and in particular to improvements in such gas operated fireplaces.

BACKGROUND ART

Gas operated fireplaces with sealed combustion chambers have been in use for many years. Such fireplaces may be installed in a pre-existing wood burning fireplace enclosure or in a specially configured alcove anywhere in a room. Such fireplaces typically include a firebox containing the combustion chamber and an outer casing surrounding the firebox, with a space therebetween. Located inside the firebox is a gas burner and material which, when heated, simulates a wood or coal fire. For example, artificial logs are often used to simulate wood logs. The casing has an open front larger than the firebox to permit air to enter and exit the space between the firebox and casing. The space between the firebox and outer casing is often referred to as a "room air wipe", which allows air circulation around the firebox. Typically, room air enters the air wipe below the firebox, circulates around the firebox and exits the air wipe back into the room above the firebox, thereby heating the room and cooling the firebox. Typically, louvers are located in the air wipe, both above and below the firebox. A viewing panel, or window, is positioned on the front of the firebox to allow viewing of the simulated fire and to seal the firebox to achieve a sealed combustion system.

The use of a balanced co-axial flue is well known in the art. Co-axial flues are commonly available in rigid or flexible configurations, and are used for both vertical and horizontal venting configurations. The firebox has a stub flue, which mates with the inner co-axial duct through which exhaust gases from the firebox are conveyed to external ambient. The inner co-axial duct is fastened to the stub flue by known means, such as a gear clamp or crimping. An outer fitting on the casing surrounds the stub flue to leave an annular opening to admit intake air for combustion. It mates with the outer portion of a standard co-axial flue, which is similarly held in place by a gear clamp or crimping. A sealed manifold assembly carries the intake air from the annular opening to the firebox for combustion. While exhaust gases flow out the inner duct, their place is taken by intake air which flows inward along the outer, annular passage of the balanced flue. Counterflow heat transfer from the exhaust gases thereby pre-heats the incoming air.

Considerable effort has been devoted to making the gas fire and artificial logs look like a real wood fire. Real wood fires have predominantly yellow flames, which are typically associated with lower flame temperatures and higher levels of carbon monoxide emissions. The challenge is to provide an attractive yellow flame pattern and still meet applicable emission standards. Because complete combustion of the gas usually results in a blue flame, rather than a yellow flame normally associated with a real wood fire, it has been difficult to achieve both complete combustion of the gas and the visual appearance of a real wood fire. Various techniques have been used, including flame deflectors and chemical additives, in order to achieve a yellow flame appearance with complete combustion of the gas. Glowing ember strips, or emberizing materials, have been used to simulate beds of glowing coals under or in front of artificial fires. These strips often serve an additional cosmetic purpose in hiding the gas burner element. The glowing appearance of a real wood fire is difficult to achieve. It depends on the choice of artificial log material, which may be coated aluminum, solid ceramic, concrete, soft ceramic, or other material. It also depends on the geometry of the burner ports, the orientation of the burner relative to the artificial logs, the extent to which the flames impinge on the artificial logs, and the orientation of the artificial logs relative to each other and relative to any ember strips or emberizing materials.

Construction of existing prior art log fireplaces illustrates several problems. Almost all fireplaces now use a room air wipe. Many fireplaces use balanced flues. A recurring difficulty is how to carry the intake air from the balanced flue to the firebox, since it must traverse the air wipe in some way. There have been many variations. For example, units such as those described in U.S. Pat. Nos. 4,793,322 to Shimek, 4,909,227 to Rieger, and 5,267,552 to Squires, et at., all show configurations of rectilinear ductwork. Typically, sheet metal is folded to form rectilinear passageways. These folded sheet metal ducts are then incorporated in the structure to mate with the fireplace casing, or the firebox, or both.

Not only has the location of the intake ductwork been problematic, but fabrication of the firebox and casing enclosure has been complicated. In a balanced flue system, combustion air ducts, whether for intake or exhaust, must be sealed. Sealing is traditionally done by spot welding the seams of the ductwork and partitions within the units and then covering the seam with a sealant such as silicone. Welding the firebox and casing creates several problems. First, it is commonly associated with unitary fireplace construction. Unitary construction yields a heavy, cumbersome fireplace that usually cannot easily be repaired or replaced. Access to components is difficult once the unit is assembled. Second, it is difficult to maintain consistent quality along the welded seams. The sheet metal panels tend to warp and each successive weld makes it more difficult to maintain a fixed tolerance on the subsequent welds, thereby resulting in lower quality products in general. Third, the warpage in the panels and the residual stresses along the welded joints makes the fireplaces noisy. Heating and cooling cause the structure to flex and undesirable noises are emitted during flexure. Fourth, welding itself is also associated with a host of health and safety problems. Therefore, there has been a long-felt need both to simplify the intake air arrangement of sealed combustion fireplaces and to reduce or eliminate the welding required in their fabrication.

Yet another problem involves servicing the fireplace components. Typically, the entire fireplace assembly must be removed for servicing, which requires a service technician to cut into the room wall in order to remove the fireplace assembly. It is also difficult to obtain access to components, such as the burner or gas control valve. A related problem is that once an entire fireplace assembly has been installed during initial construction of a building it is susceptible to damage during subsequent stages of construction. Alternatively, in retrofit installations, a portion of a room wall must be removed to provide an alcove for installation of the fireplace assembly. Particularly during new construction, the fireplace assembly is susceptible to theft and damage. Still another problem associated with prior art artificial log fireplaces is that the alcove in which the fireplace assembly is installed must have sufficient space to accommodate the exhaust flue. The exhaust flue may be either vertical (i.e., emanating from a top panel of the fireplace assembly) or horizontal (i.e., emanating from a rear panel of the fireplace assembly). It is known in the art to provide a "universal" flue, which can be configured for either vertical or horizontal exhaust. However, the alcove must be made sufficiently large to accommodate a bend in the exhaust flue to achieve the desired vertical or horizontal orientation. It is known in the art to provide a top panel of the fireplace assembly having a 45° downward slope. A 45° sloped top permits either horizontal or vertical installation with the use of a rotatable 45° elbow. However, the permissible minimum bend radius of a balanced co-axial flue is such that a greater than desired alcove depth may be required to accommodate a vertical 45° arc of venting.

There is, therefore, a need for an improved gas operated fireplace assembly.

DISCLOSURE OF INVENTION

A gas operated fireplace assembly is provided having a casing with an open front; a firebox mounted within the casing and in spaced relationship therewith to define an air wipe between the firebox and casing; a burner mounted within the firebox for burning combustible gas in a combustion chamber located inside the firebox; combustion air-intake means located within the air wipe and in fluid communication between a combustion air source and the firebox for introducing combustion air into the combustion chamber; and exhaust means for exhausting products of combustion from the combustion chamber. In accordance with one aspect of the invention, the casing, firebox, burner and air-intake means are discrete modules which can be assembled at a manufacturing facility and shipped to an installation site as a unitary fireplace product. Alternatively, the modules can be shipped as a kit and assembled at the installation site. The modular fireplace construction according to the present invention not only facilitates manufacture, shipping and installation, but also replacement of spare parts and spare part inventory control.

The casing is adapted to be positioned in an enclosure adjacent a room with the open front of the casing facing the room. The firebox is insertable into the casing through the open front thereof and is removably mountable within the casing such that the firebox is removable without having to remove the casing from the enclosure. This feature provides a significant advantage in that the casing can be installed during the "rough-in" stage of construction and the other modules, including the firebox, burner and combustion air-intake modules, can be installed at a later time. Thus, the room can be configured for a gas operated fireplace assembly by building the enclosure and installing the casing during the initial construction of a building. Other modules may be installed later. The burner module is preferably removably mounted within the firebox and the combustion air-intake module is preferably removably mounted within the casing to facilitate servicing and replacement thereof.

In accordance with another aspect of the invention, the burner module includes a substantially U-shaped burner tube connectible to a combustible gas source. The burner tube has a plurality of apertures configured to provide a predetermined flame pattern when combustible gas emanating from the apertures is burned. The burner tube includes generally parallel first and second horizontal tube runs with a substantially U-shaped section therebetween. The first horizontal tube run is located in front of and below the second horizontal tube run. Support means is provided for supporting a plurality of fuel-simulating logs (e.g., artificial wood logs) inside the firebox. The support means includes means for supporting a first log in a first position behind and in partially overhanging relationship with the first horizontal tube run such that a first flame pattern emanating from the first horizontal tube run impinges obliquely on a first lower front portion of the first log and generally follows the contour of the first lower front portion upwardly. The support means further includes means for supporting a second log in a second position behind and in partially overhanging relationship with the second horizontal tube run such that a second flame pattern emanating from the second horizontal tube run impinges obliquely on the second lower front portion of the second log and generally follows the contour of the second lower front portion upwardly.

Locating means is provided for locating the first log in the first position. The locating means is adapted to contact the first horizontal tube run to maintain a predetermined spacing between the first horizontal tube run and the first lower front portion. The second log is preferably in contact with the second horizontal tube run. The support means further includes means for supporting a third log in a third position in front of and in contact with the first horizontal tube run such that the first horizontal tube run is intermediate the first and third logs and a predetermined clearance (preferably ½ inch) is maintained between the first and third logs above the first horizontal tube run. The first flame pattern is constrained to pass through the predetermined clearance.

In accordance with yet another aspect of the invention, the air-intake means includes an air-intake manifold removably mounted within the air wipe in fluid communication with the combustion air source for receiving combustion air and at least one substantially cylindrical tube communicating between the manifold and the firebox to define a combustion air passageway for introducing combustion air into the firebox. The combustion air-intake means preferably includes a plurality of substantially cylindrical tubes communicating between the manifold and the firebox to define a plurality of discrete combustion air passageways. The tubes are located within and surrounded by the air wipe such that room air circulating through the air wipe is able to flow around the tubes. The tubes are coupled at respective first ends thereof to the manifold and at respective second ends thereof, opposite from the corresponding first ends, to the firebox without welding. The respective first ends of the tubes are preferably swaged into the manifold and the respective second ends thereof are preferably swaged into a header member mounted on the firebox.

In accordance with still another aspect of the invention, the firebox is assembled without welding to facilitate disassembly thereof. The firebox includes a top member having a first panel and a first rim depending from the top panel; an intermediate member having generally opposed second and third panels and a fourth panel extending between the second and third panels; and a bottom member having a fifth panel and a second rim extending upwardly from the fifth panel. First fastener means is provided for removably fastening the first rim to respective upper portions of the second, third and fourth panels with the first rim surrounding the respective upper portions, whereby the top member is removably joined to the intermediate member. Second fastener means is provided for removably fastening the second rim to respective lower portions of the second, third and fourth panels with the second rim surrounding the respective lower portions, whereby the bottom member is removably joined to the intermediate member. The first panel defines a top panel of the firebox, the second and third panels define respective side panels of the firebox, the fourth panel defines a back panel of the firebox and the fifth panel defines a bottom panel of the firebox. Sealing means is provided for sealing the firebox to provide a sealed combustion chamber therein. In accordance with one embodiment of the invention, the sealing means includes a first gasket interposed between the first rim and the respective upper portions of the second, third and fourth panels and in compressive contact therebetween, and a second gasket interposed between the second rim and the respective lower portions of the second, third and fourth panels and in compressive contact therebetween.

In accordance with a further aspect of the invention, the casing and firebox have respective top panels which are sloped at approximately 25° relative to a horizontal axis. The 25° sloped top of the fireplace assembly facilitates use of a universal flue configuration, whereby an exhaust flue for exhausting products of combustion from the fireplace assembly can be routed either vertically or horizontally, while still maintaining the front-to-back depth of the fireplace assembly within an acceptable limit (e.g., 16"). The fireplace assembly is also compatible with a balanced flue configuration in which a double-walled duct is connected to the fireplace for exhausting products of combustion through an inner passageway defined by an inner wall of the duct and combustion air flows through an annular outer passageway surrounding the inner wall in counterflow relationship to the products of combustion in the inner passageway.

To accommodate a balanced flue configuration, the respective sloped top panels of the casing and firebox have respective first and second openings in concentric relationship. The air-intake manifold has a third opening and the manifold is mounted within the air wipe over the first opening with a third opening in concentric relationship with the first and second openings and intermediate the first and second openings. The exhaust means includes a flue mounted over the second opening and in communication with the combustion chamber of the firebox through the second opening. The flue extends slideably through the third and first openings and outwardly from the casing in a direction generally perpendicular to the sloped top panels of the casing and firebox for engagement with the inner wall of the duct external to the casing. Products of combustion are exhausted from the combustion chamber through the flue and through the inner passageway.

An adaptor is mounted on the sloped top panel of the casing in fluid communication with the air-intake manifold through the first opening, such that at least a portion of the adaptor extends outwardly from the casing in a direction generally perpendicular to the top panel of the casing for engagement with an outer wall of the duct. Combustion air flows through the outer passageway between the inner and outer walls of the duct and through the adaptor into the manifold in counterflow relationship to the products of combustion in the inner passageway. The combustion air is received in the air-intake manifold and is supplied to the combustion chamber through the tubes communicating between the manifold and the firebox within the air wipe. Room air circulating through the air wipe around the firebox is heated, thereby heating the room. The source of combustion air is preferably external to the room to provide a sealed gas operated fireplace assembly.

BEST MODE FOR CARRYING OUT THE INVENTION

Figure 1:
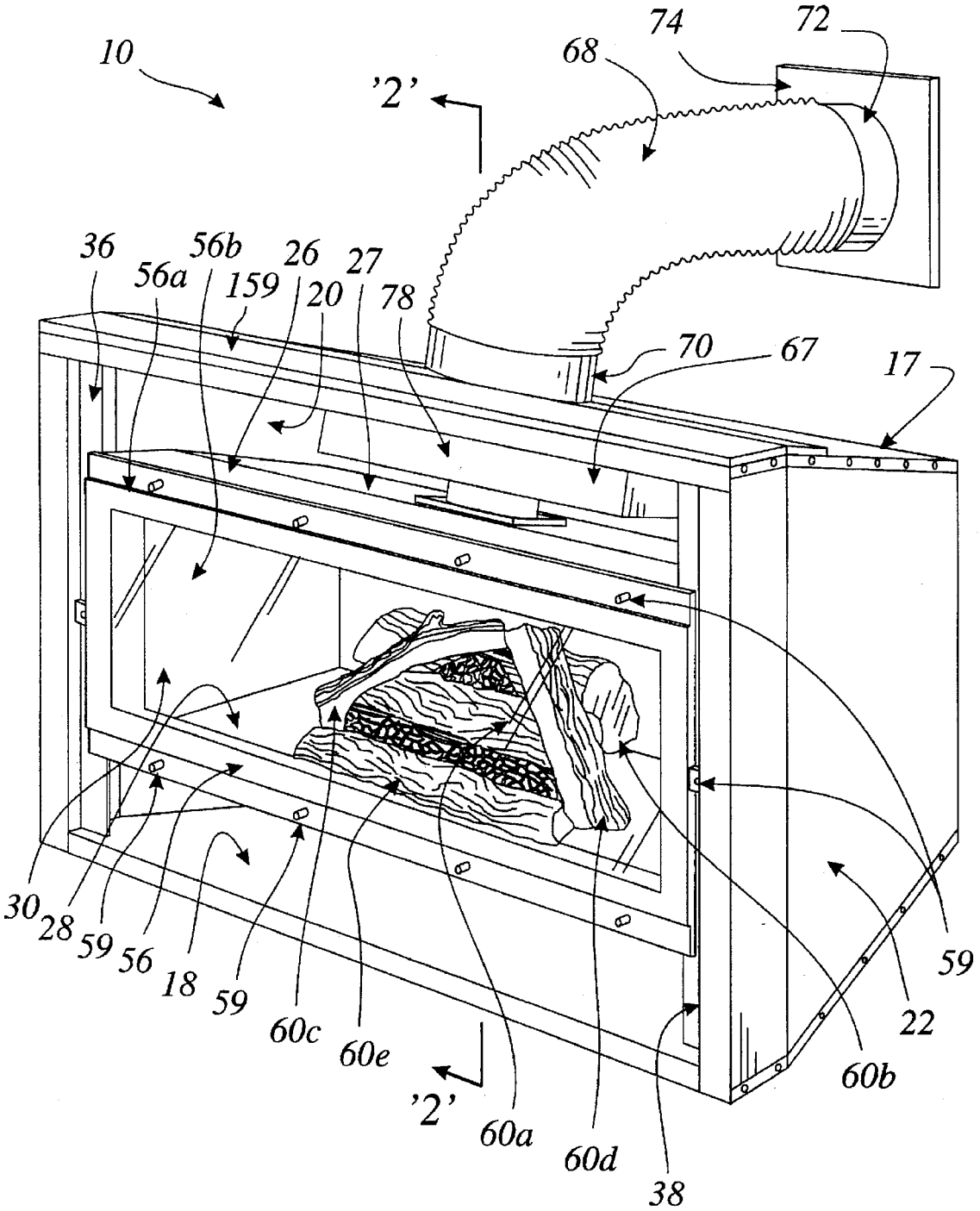
FIG. 1 is a perspective view of a gas operated modular fireplace assembly, according to the present invention.

In the description which follows, like parts are marked throughout the specification and the drawings with the same respective reference numerals. The drawings are not necessarily to scale and in some instances proportions may have been exaggerated in order to more clearly depict certain features of the invention.

Figure 2:
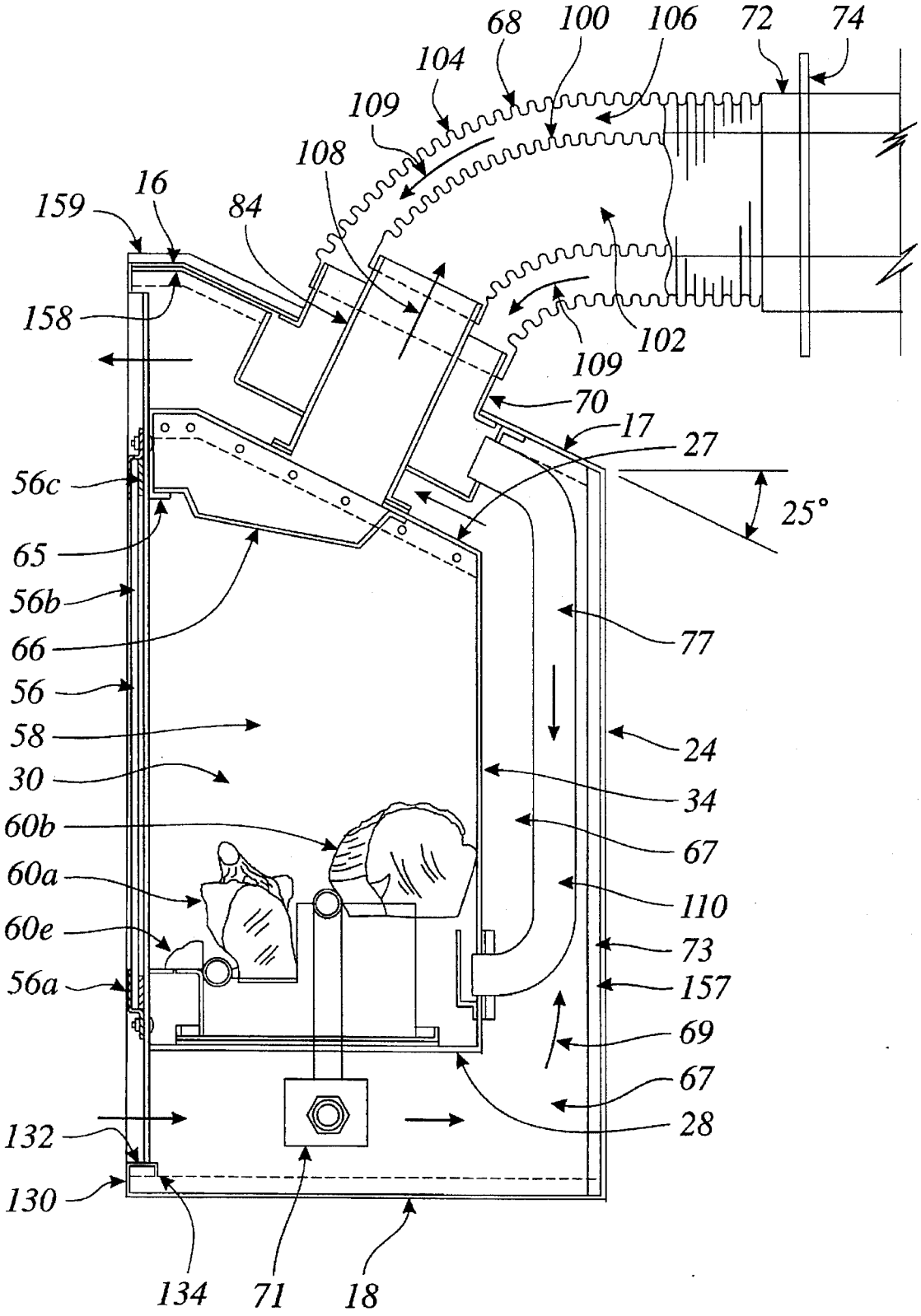
FIG. 2 is a cross-sectional view of the modular fireplace assembly, taken along the line 2—2 of FIG. 1.
Figure 3:
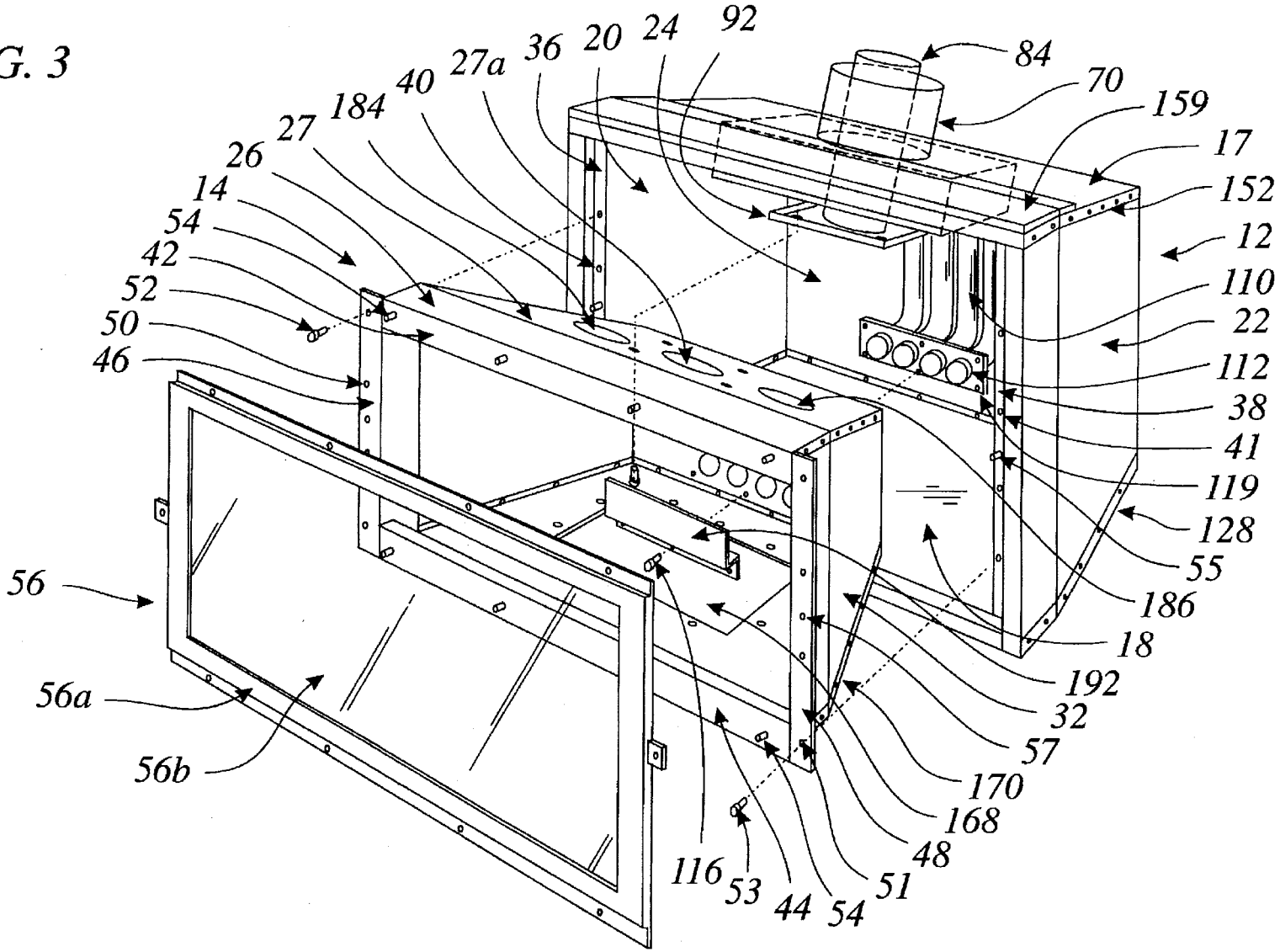
FIG. 3 is an exploded perspective view of the fireplace of FIG. 1 showing a viewing panel, a firebox, a casing and an air-intake module.

Referring to FIGS. 1–3, a modular fireplace assembly 10 is comprised of a plurality of modules, including an outer casing 12 and a firebox 14. Casing 12 has a rectangular open front, a top panel 16, a bottom panel 18, side panels 20 and 22 and a rear panel 24. Firebox 14 has a rectangular open front, a top panel 26, a bottom panel 28, side panels 30 and 32 and a rear panel 34. As can be best seen in FIG. 3, casing 12 has opposed side mounting flanges 36 and 38, which are recessed slightly rearward from the open front of casing 12. Flange 36 has four pre-drilled mounting holes 40 and flange 38 has four pre-drilled mounting holes 41. Firebox 14 has a top flange 42, a bottom flange 44 and side flanges 46 and 48 surrounding the open front of firebox 14. Side flange 46 has four pre-drilled mounting holes 50 and side flange 48 has four pre-drilled mounting holes 51. Firebox 14 is mounted with casing 12 by positioning firebox 14 such that holes 50 are aligned with respective holes 40 and holes 51 are aligned with respective holes 41. Four fasteners 52 (e.g., sheet metal screws) are used to secure flange 46 flange in facing contact with flange 36 and four fasteners 53 (e.g., sheet metal screws) are used to secure flange 48 in facing contact with flange 38, whereby firebox 14 is suspended within casing 12, as can be best seen in FIG. 1.

A plurality of threaded studs 54 (FIG. 3) extend outwardly from each flange 42, 44 and one stud 55 extends outwardly from each flange 36, 38. Studs 55 extend through respective holes 57 in flanges 46 and 48. Studs 55 act as indexing pins to locate firebox 14 with respect to casing 12, to facilitate mounting firebox 14 with casing 12, as described hereinabove. A rectangular viewing panel 56 overlaps the front of firebox 14. It comprises a retaining bezel **56*a*, which retains a sheet of glass 56*b*, of a kind suitable for exposure to high temperatures, and a heat resistant circumferential gasket 56*c*, affixed to the inner face of glass 56*b*. Retaining bezel 56*a* is provided with clearance holes suited to locate about threaded studs 54 and 55. A plurality of attachment members 59 (FIG. 1), such as threaded nuts, are provided to secure the retaining bezel 56***a*, to studs 54 and 55, thereby causing gasket 56*c* to be compressed between glass 56*b* and flanges 42, 44, 46, and 48. Installation of panel 56 thus seals the front face of firebox 14. A decorative sheet metal picture frame, not shown, locates about panel 56 to hide nuts 59 and studs 54 and 55 from view.

The interior of firebox 14 defines a combustion chamber 58. Located in combustion chamber 58 are a plurality of artificial logs 60 (e.g., wood-simulating logs) and a burner module 63. Although wood-simulating log material will be referred to hereinafter, one skilled in the art will recognize that material for simulating a coal fire could be used in lieu of the wood-simulating log material. Burner module 63 includes a gas burner tube 64 having a U-shaped configuration with a front horizontal tube run 64*a* and a rear horizontal tube run 64*b* located above and behind tube run 64*a*. Burner module 63 further includes a two-tier support member 62 for supporting logs 60, as will be described in greater detail hereinafter. Also located inside combustion chamber 58 is an exhaust baffle 66, which is suspended from an inwardly turned lip 65 of top flange 42. Baffle 66 extends only partially across combustion chamber 58 in a lateral direction to permit exhaust gases to flow between baffle 66 and side panels 30 and 32. The space between firebox 14 and casing 12 defines an air wipe indicated generally as 67, whereby room air is circulated around firebox 14 and heated. As indicated by arrows 69, room air enters air wipe 67 beneath firebox 14, circulates around firebox 14 and exits air wipe 67 above firebox 14. Fireplace assembly 10 may include hinged louvers (not shown) both below and above firebox 14. A control module 71 is located beneath bottom panel 28 for controlling the operation of fireplace assembly 10, including the flow of gas to burner tube 64. The interior top, rear and side surfaces of casing 12 are preferably lined with thermal insulation 73 (see FIG. 7).

Figure 7:
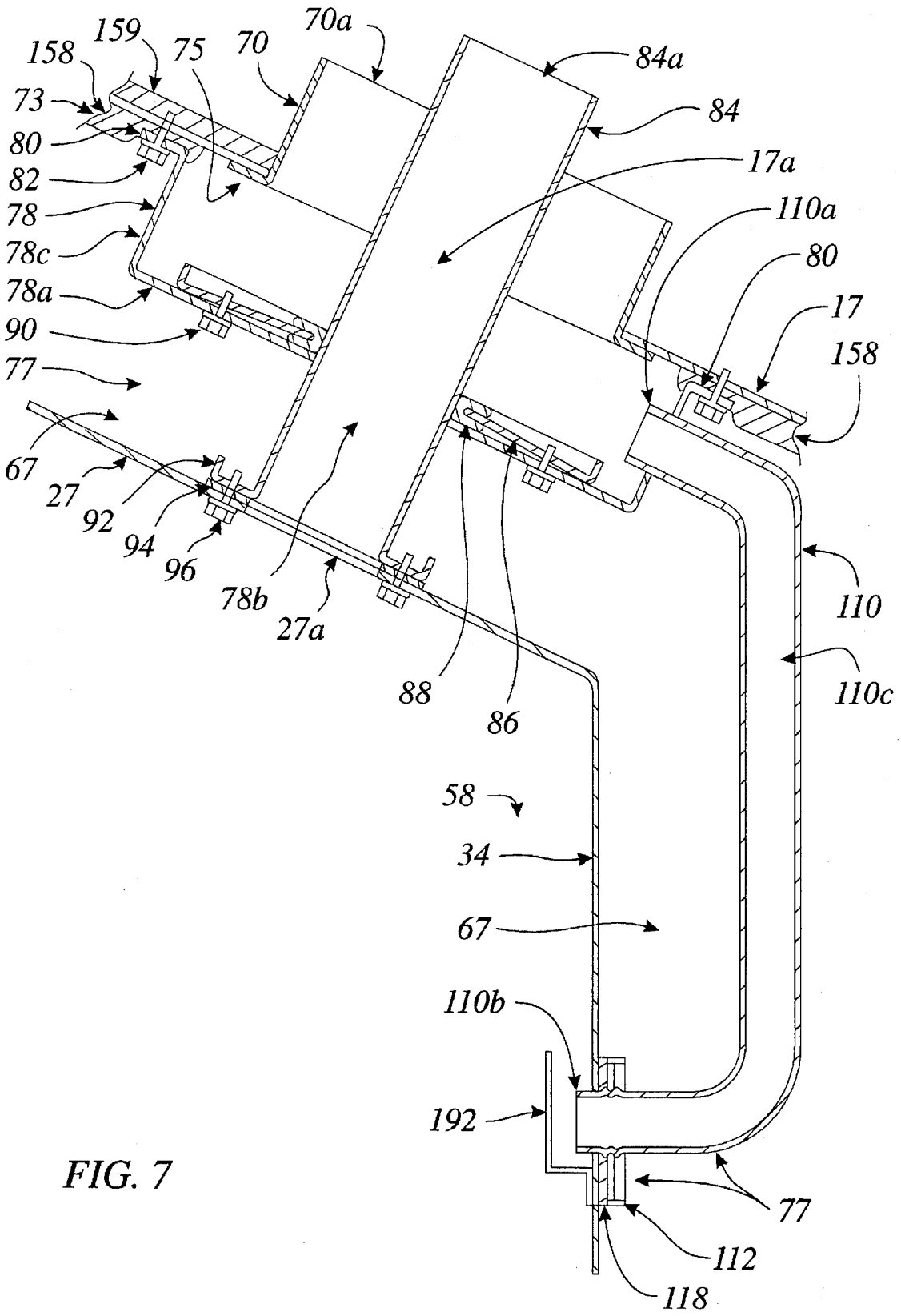
FIG. 7 is a detailed view of an air-intake manifold and combustion air conduit of the fireplace assembly of FIG. 2.

Referring also to FIG. 7, casing 12 further includes a sloped panel 17 extending between top panel 16 and rear panel 24. Firebox 14 further includes a sloped panel 27 extending between top panel 26 and rear panel 34. Panels 17 and 27 each have a downward slope from front to back of approximately 25° with respect to a horizontal axis. A double-walled coaxial duct 68 is provided for supplying combustion air to combustion chamber 58 and for exhausting products of combustion therefrom. One end of duct 68 is received in an adaptor 70, which is mounted with panel 17 and extends outwardly therefrom. The opposite end of duct 68 is received in an adaptor 72, which is mounted with a wall 74 or other structural member. Adaptor 70 has an annular mounting flange 75 on one end thereof. Flange 75 extends through an opening 17*a* in panel 17. Adaptor 70 is preferably formed as part of casing 12 by mounting adaptor 70 in facing contact with an inner surface of panel 17 by an appropriate mounting technique (e.g., spot welding or swaging).

Duct 68 is oriented substantially perpendicular to panel 17 as it emanates from adaptor 70. As can be best seen in FIG. 2, duct 68 is bendable upwardly through approximately 25° to achieve a vertical configuration, or downwardly through approximately 65° to achieve a horizontal configuration. The 25° sloped panels 17 and 27 therefore facilitate a universal flue configuration in connection with a modular fireplace assembly 10, whereby duct 68 can be oriented either vertically or horizontally while maintaining fireplace assembly 10 within acceptable height and depth parameters.

To avoid excessive intrusion into the living space of a room, it is advantageous to limit the front-to-back depth of fireplace assembly 10 to not more than 16 inches when a vertical flue configuration is used. Coaxial ducts typically have an inner diameter of four inches and an outer diameter of seven inches. When an elbow fitting is used to bend the duct, the minimum permissible elbow bend radius is one and a half times the outer diameter of the flue (i.e., 1.5×7 inches=10.5 inches) from the center of the radius of curvature to the central axis of the duct. The 25° slope of panels 17 and 27 allows the required elbow bend to lie within the aforementioned 16-inch limit.

A combustion air-intake module 77 includes a box-shaped air-intake manifold 78, a plurality of combustion air-carrying tubes 110 arranged in a parallel array, and a header member 112. Manifold 78 has a square mounting flange 80, which is mounted with the inner surface of panel 17 by appropriate fasteners 82 (e.g., bolts or screws), whereby manifold 78 is suspended from panel 17 within air wipe 67. Thermal insulation 73 is interposed between flange 80 and panel 17, to seal the interior of manifold 78 from air wipe 67. A bottom portion 78*a* of manifold 78 has a central opening 78*b* in concentric relationship with opening 17*a* in panel 17. Because manifold 78 is mounted in air wipe 67, inside casing 12 rather than external thereto, the height of fireplace assembly 10 is reduced, as compared to fireplace assemblies having air-intake manifolds external to the fireplace casing, thereby reducing the space required for installation of fireplace assembly 10.

A stub flue 84 is mounted with firebox 14, as described hereinbelow, and extends outwardly therefrom through openings 78*b* and 17*a*. Stub flue 84 is of sufficient length that, when installed, its distal end 84*a* extends beyond the distal end 70*a* of adaptor 70. A seal plate 86 is attached at the bottom of manifold 78 and captures a double-folded, heat resistant gasket 88, which surrounds the bottom opening in manifold 78. Seal plate 86 is attached to bottom portion 78*a* with appropriate fasteners 90 (e.g., bolts or screws). The bottom opening, seal plate 86 and gasket 88 are sized to permit stub flue 84 to pass therethrough in compressive contact around its perimeter with gasket 88. Gasket 88 allows stub flue 84 to move relative to manifold 78.

The opposite end of stub flue 84 from distal end 84*a* terminates with a square mounting flange 92. A bottom face of mounting flange 92 carries a heat resistant gasket 94, which is interposed between mounting flange 92 and an outer surface of panel 27. Mounting flange 92 is secured to panel 27 with appropriate fasteners 96 (e.g., bolts or screws) to enclose a central opening 27*a* in panel 27, such that stub flue 84 communicates with combustion chamber 58 opening 27*a*.

Duct 68 has a corrugated cylindrical inner wall 100 defining an inner passageway 102 and a corrugated cylindrical outer wall 104 in coaxial relationship with inner wall 100 defining an outer passageway 106. Inner wall 100 is adapted for mating engagement with stub flue 84, whereby products of combustion are exhausted from combustion chamber 58 through inner passageway 102 in the direction of arrow 108. Inner passageway 102 therefore serves as an exhaust flue. Outside air for combustion flows through outer passageway 106 in the direction of arrows 109 (i.e., in counterflow relationship to the exhaust gases), to provide a balanced flue configuration. The combustion air is preheated and the exhaust gases are cooled, thereby enhancing the efficiency of fireplace assembly 10.

Respective first ends 110*a* of tubes 110 extend through respective ports in side wall 78*c* of manifold 78 and are swaged against an inner surface of wall 78*c*, as can be best seen in FIG. 7. Although four tubes 110 are shown in FIG. 3, one skilled in the art will recognize that the number of tubes 110 may be greater or less than four. An upper portion of each tube 110 is bent downwardly through an angle of approximately 65°. The major portion of each tube 110 then extends substantially vertically downward through air wipe 67. A bottom portion of each tube 110 is bent upwardly through an angle of approximately 90° so that the bottom portion of the corresponding tube 110 is oriented substantially horizontally.

Tubes 110 traverse respective ports in a header member 112 and are swaged against an inner surface of header member 112. As can be best seen in FIG. 3, rear panel 34 of firebox 14 has a corresponding plurality of pre-drilled clearance openings 114 which are alignable with the respective ports in header member 112. A plurality of fasteners 116 such as sheet metal screws are adapted to extend through respective pairs of aligned holes 117 and 119 in panel 34 and header member 112, respectively, for securing header member 112 to rear panel 34, with openings 114 aligned with the respective ports in header member 112. A heat-resistant gasket 118 is interposed between header member 112 and panel 34, as shown in FIG. 7. Respective second ends **110*b* of tubes 110 extend through openings 114 such that tubes 110 communicate between manifold 78 and combustion chamber 58 for introducing pre-heated combustion air into firebox 14. The interior of each tube 110 defines a combustion air passageway 110*c***.

Tubes 110 preferably have a nominal diameter of approximately 1.5 inches and can be manufactured and bent from standard stock steel using high-speed equipment. Further, no welding is required to attach tubes 110 to manifold 78 and header member 112, rather, a cold forming means, preferably swaging, is used. As can be best seen in FIG. 3, firebox 14 is easily removed from casing 12 by first removing viewing panel 56, then removing fasteners 116 to uncouple rear panel 34 from header member 112. Fasteners 96 are then removed to release baffle 66 and flange 92. Finally, removal of fasteners 52 and 53 uncouples flanges 46 and 48 from flanges 36 and 38 respectively. Firebox 14 and the components associated therewith can then be serviced without disturbing casing 12.

Modular construction permits the casing 12 (including adaptor 70) to be installed during the "rough-in" stage of building construction. The casing 12 is preferably installed in a specially-configured alcove or other enclosure in or adjacent to a living space and is anchored to the floor using basic wood screws (not shown). The "rough-in" installation also preferably includes the combustion air-intake module 77 (i.e., manifold 78, tubes 110 and header member 112) and stub flue 84. The remaining modules, including firebox 14, burner module 63, logs 60 and various control components, may be installed at a later time, at the option of the building occupant. Further, by minimizing the components installed during the rough-in stage of construction, the likelihood of theft or vandalism is reduced.

Figure 4:
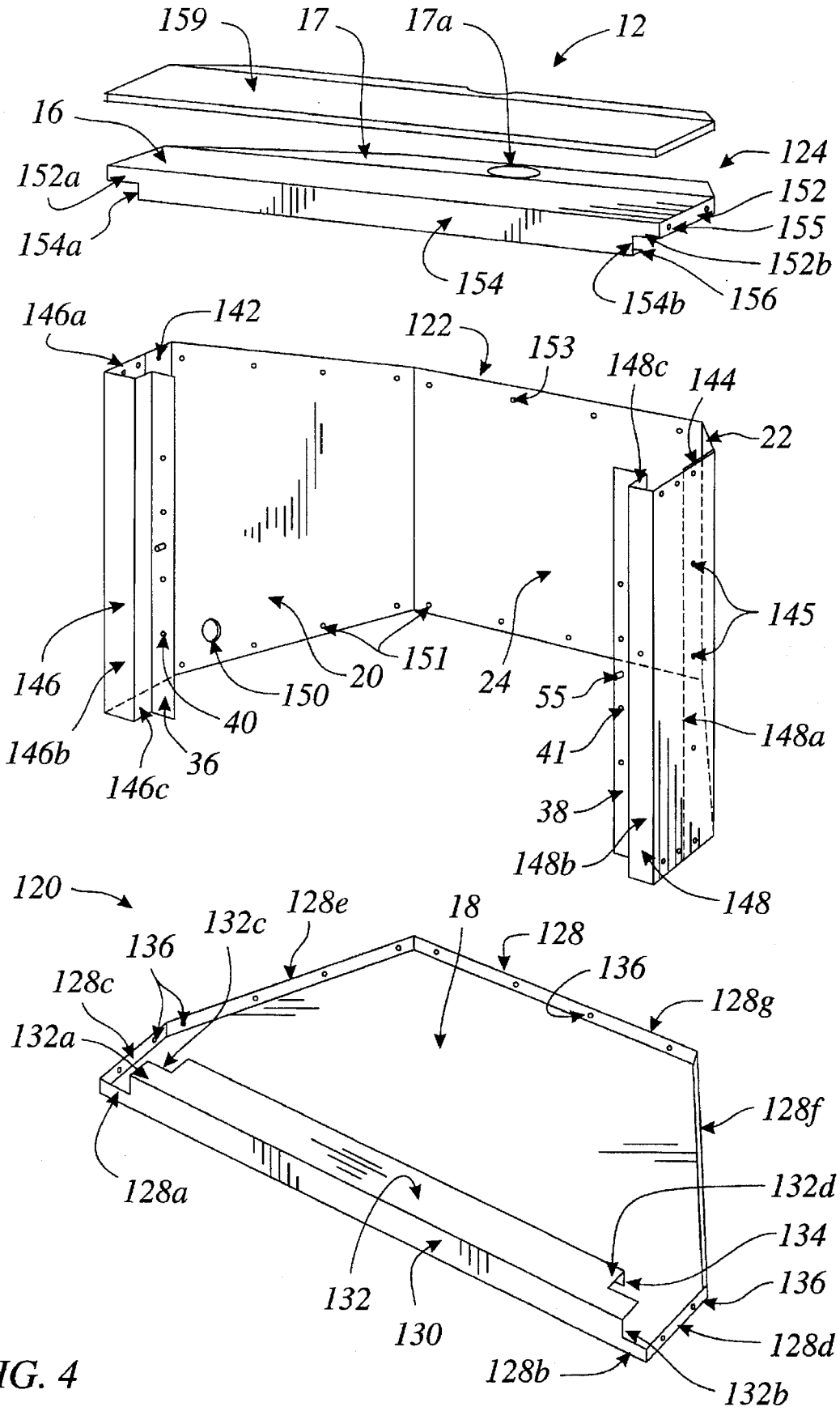
FIG. 4 is an exploded perspective view of the casing of FIG. 3.

Referring to FIG. 4, casing 12 is comprised of three major components, a bottom member 120, an intermediate member 122 and a top member 124. Bottom member 120 includes a bottom panel 18 and an upstanding rim 128, which defines the perimeter of the back and sides of panel 18 and wraps partially around the front thereof. Rim 128 includes front portions **128*a* and 128*b*, opposed front side portions 128*c* and 128*d*, rear side portions 128*e* and 128*f*, and back portion 128*g*. The front of bottom member 120 is defined by front portions 128*a* and 128*b* and an upstanding flange 130. A flange 132 extends inwardly from flange 130 and a downturned lip 134 depends from flange 132. Rim 128 (except for front portions 128*a* and 128*b*) has a plurality of fastener-receiving holes 136**.

In addition to side panels 20 and 22 and rear panel 24, intermediate member 122 includes opposed front side panels 142 and 144 and opposed front corner beams 146 and 148. Panels 20 and 22 are sloped downwardly from respective panels 142 and 144 to conform to the slope of top panel 17. A section **146*a* of beam 146 is joined in overlapping relationship with front side panel 142 and a section 148*a* of beam 148 is joined in overlapping relationship with front side panel 144 using appropriate fasteners such as sheet metal screws 145. Panel 142 is in facing contact with and inside of section 146*a* and panel 144 is in facing contact with and inside of section 148*a*. Beam 146 further includes a front facing section 146*b* and an inwardly facing section 146*c*. Beam 148 further includes a front facing section 148*b* and an inwardly facing section 148*c*. Mounting flanges 36 and 38 extend inwardly from respective sections 146*c* and 148*c*. Side panels 20 and 22 each have an aperture 150 to accommodate a gas supply conduit (not shown). Typically, only one of the apertures 150 is used at any given time, depending upon the location of the gas supply conduit. Electrical knock-out blanks (not shown) are also provided adjacent apertures 150 to permit operation of the fireplace by remote electrical connection. Intermediate member 122 (except for sections 146*b*, 146*c*, 148*b* and 148*c*, and flanges 36 and 38) has a plurality of fastener-receiving holes 151 adjacent the bottom edges thereof and a plurality of fastener-receiving holes 153** adjacent the top edges thereof.

Casing 12 is assembled by joining members 120, 122 and 124. Intermediate member 122 is joined to bottom member 120 by positioning intermediate member 122 with its bottom edges resting on base panel 18 inside rim 128 and respective outer surfaces of panels 20, 22 and 24 and sections **146*a*, 146*b*, 148*a* and 148*b* in facing contact with respective inner surfaces of rim 128. Specifically, respective lower portions of side panels 20 and 22 are in facing contact with rear side portions 128*e* and 128*f*, respectively; a lower portion of rear panel 24 is in contact with back portion 128*g*; respective lower portions of sections 146*a* and 148*a* are in facing contact with front side portions 128*c* and 128*d*, respectively; respective lower portions of front facing sections 146*b* and 148*b* are in facing contact with front portions 128*a* and 128*b*, respectively; respective lower portions of sections 146*c* and 148*c* are in contact with opposed end edges 132*a* and 132*b*, respectively, of flange 132; and respective lower portions of mounting flanges 36 and 38 are in contact with inner edges 132*c* and 132*d*, respectively, of flange 132. When intermediate member 122 is properly seated within bottom member 120, holes 151 are aligned with respective holes 136. Fasteners such as sheet metal screws (not shown) are insert through the aligned pairs of holes 136, 151 to join intermediate member 122 to bottom member 120. The fasteners are removable to allow intermediate member 122 to be disjoined from bottom member 120**.

Top member 124 is joined to intermediate member 122 by positioning top member 124 over the upper portion of intermediate member 122, with the top edges of intermediate member 122 in contact with panels 16 and 17 inside of a rim 152, which depends from top member 124 around panels 16 and 17 and partially around the front of top member 124. The respective outer surfaces of panels 20, 22 and 24 and sections **146*a*, 146*b*, 148*a* and 148*b* are in facing contact with respective inner surfaces of rim 152. The front of top member 124 is defined by front portions 152*a* and 152*b* of rim 152 and a depending flange 154 having an inwardly-turned lip 156. Rim 152 (except for front portions 152*a* and 152*b*) has a plurality of fastener-receiving holes 155. Once rim 152 is formed adaptor 70** is installed as noted above.

When top member 124 is properly positioned on intermediate member 122, holes 155 are aligned with respective holes 153; respective upper portions of sections 146*b* and 148*b* are in facing contact with front rim portions 152*a* and 152*b*, respectively; respective upper portions of sections 146*c* and 148*c* are in contact with opposed end edges 154*a* and 154*b*, respectively, of flange 154; and respective upper portions of flanges 36 and 38 are in contact with lip 156. Appropriate fasteners such as sheet metal screws (not shown) are inserted through the aligned pairs of holes 153, 155 to join top member 124 to intermediate member 122, thereby completing assembly of casing 12. The assembled casing 12 can be best seen in FIG. 3. The fasteners are removable to allow top member 124 to be disjoined from intermediate member 122. For clarity thermal insulation 73 has been omitted from FIG. 4. It comprises main insulation blanket 157 cut and folded to confrom to the inner surface of, and is affixed to, panels 20, 22 and 24; and, affixed to the underside of panels 16 and 17, an upper insulation blanket 158 suitably trimmed to serve as a gasket between mounting flange 80 and panel 17, without occluding opening 17*a*. An insulation pad 159 is affixed externally to top member 124 covering panel 16 and partially covering panel 17.

Figure 5:
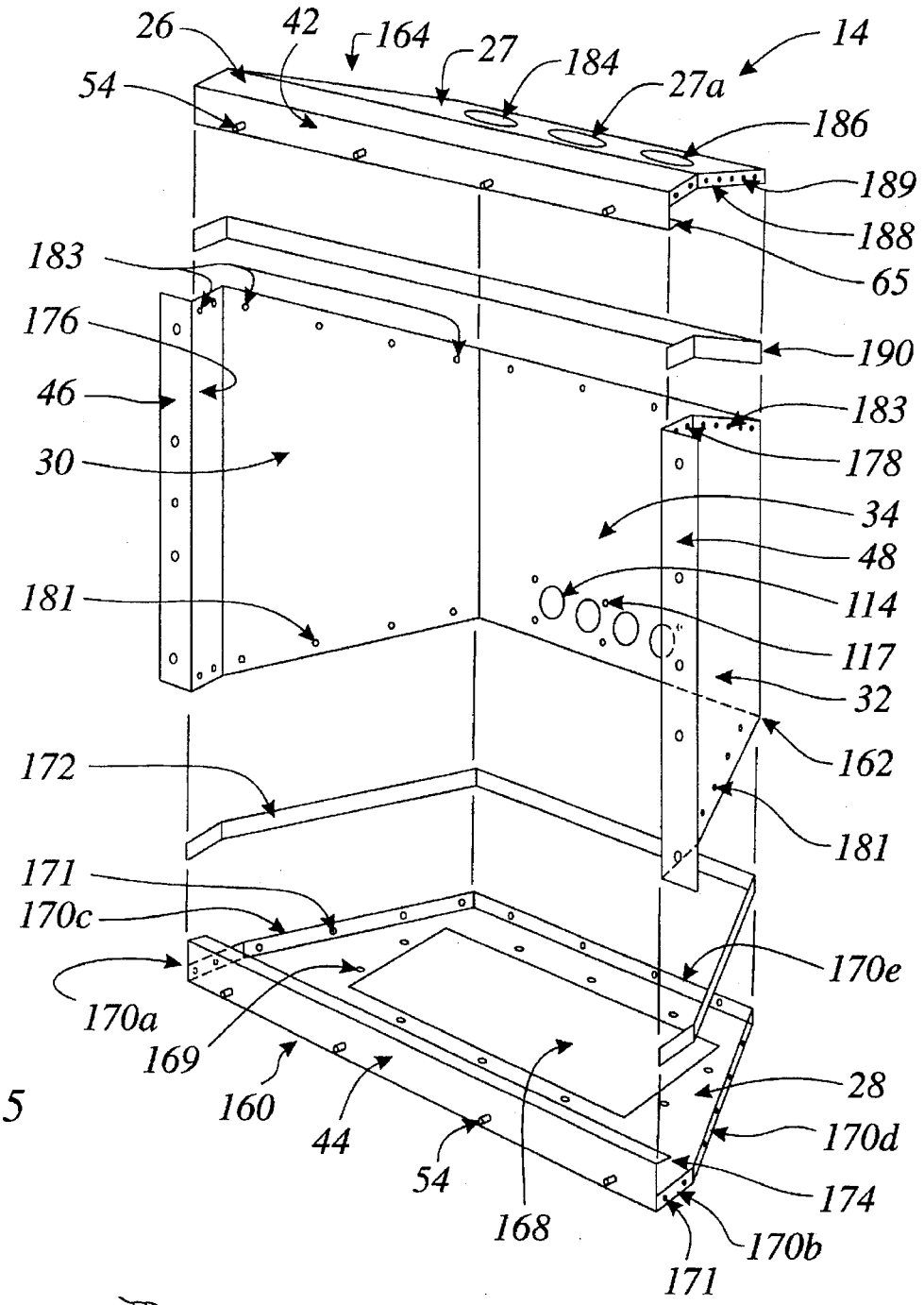
FIG. 5 is an exploded perspective view of the firebox of FIG. 3.

Referring now to FIG. 5, the assembly of firebox 14 will now be described in detail. Firebox 14 also includes three primary components, a bottom member 160, an intermediate member 162 and a top member 164. Bottom member 160 includes bottom panel 28 with a rectangular central opening 168 and a plurality of fastener-receiving holes 169 surrounding opening 168. An upstanding rim 170 defines the perimeter of the back and sides of panel 28 and terminates at the front thereof. Rim 170 includes front side portions 170*a* and 170*b*, rear side portions 170*c* and 170*d*, and back portion 170*e*. Rim 170 has a plurality of fastener-receiving holes 171. The front of bottom member 160 is defined by upstanding flange 44, which has an inwardly-turned lip 174.

Intermediate member 162 includes opposed front side sections 176 and 178, as well as side panels 30 and 32, rear panel 34 and mounting flanges 46 and 48. Panels 30 and 32 are sloped downwardly from respective sections 176 and 178 to rear panel 34 to conform to the slope of top panel 27. Intermediate member 162 is joined to bottom member 160 by positioning intermediate member 162 with its bottom edges resting on bottom panel 28 inside rim 170. A heat-resistant gasket 172 is interposed between respective outer surfaces of intermediate member 162 (specifically, sections 176 and 178 and panels 30, 34 and 32) and the inner surfaces of rim 170, a bead of high temperature silicone sealant (such as SU 5009 silicon sealant sold by Silicones Unlimited of Marietta, Ga.) preferable having been applied to the outside face of gasket 172. In all cases referred to in this specification where a heat resistant gasket is used, except as concerns panel 56, it will be understood that a high temperature silicone sealant is applied to the gasket before the gasket is captured and compressed between facing surfaces. Intermediate member 162 has a plurality of fastener-receiving holes 181 adjacent the bottom edges thereof and a plurality of fastener-receiving holes 183 adjacent the top edges thereof. Holes 171 are aligned with respective holes 181 and appropriate fasteners such as sheet metal screws (not shown) are inserted through the aligned groups of holes 171 and 181 to pierce gasket 172 and to join intermediate member 162 to bottom member 160 with gasket 172 in compressive contact between rim 170 and a lower portion of bottom member 162. Lip 174 is in contact with flanges 46 and 48. When intermediate member 162 is joined to bottom member 160, respective inner surfaces of section 176, panel 30, panel 34, panel 32 and section 178 are in facing relationship with respective portions 170*a*, 170*b*, 170*c*, 170*d* and 170*e* of rim 170.

Top member 164 has a rim 188 depending from panels 26 and 27 and terminating at the front of top member 164 at opposed ends of downturned flange 42. Flange 42 defines the front of top member 164 and has an inwardly extending lip 65 as noted above. In addition to opening 27*a*, sloped panel 27 has two exhaust relief openings 184 and 186. Although not shown, a relief valve is mounted above each opening 184, 186, for relieving excess pressure from combustion chamber 58 into air wipe 67. Rim 188 has a plurality of fastener-receiving holes 189.

Top member 164 is joined to intermediate member 162 by positioning top member 164 over the upper portion of intermediate member 162 with the top edges of intermediate member 162 in contact with panels 26 and 27 inside of rim 188. A heat-resistant gasket 190 is interposed between the inner surfaces of rim 188 and the respective outer surfaces of sections 176 and 178 and panels 30, 32 and 34. Holes 189 are aligned with respective holes 183 and appropriate fasteners (not shown) are inserted through the respective aligned groups of holes 183 and 189 to pierce gasket 190 and to join top member 164 to intermediate member 162 with gasket 190 in compressive contact between rim 188 and an upper portion of intermediate member 162. Lip 65 is in contact with flanges 46 and 48. Firebox 14 is therefore assembled with only two seams, one seam being between top member 164 and intermediate member 162 and the other seam being between intermediate member 162 and bottom member 160. The two seams are sealed with heat-resistant gaskets 172 and 190, thereby obviating the need for welding along the seams.

Baffle 66 is suspended from lip 65 and from inclined panel 27. Central opening 168 is adapted to accommodate burner module 63, as will be described in greater detail hereinafter. A second baffle 192 is mounted on assembly with intake-air module 77 in spaced relationship to clearance openings 114 by means of two of fastener 116 and corresponding holes 117.

Figure 6:
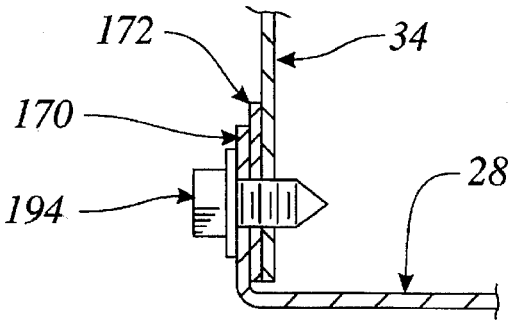
FIG. 6 is a detailed view of a portion of the firebox of FIG. 5, illustrating the removable attachment of the components thereof.

Referring to FIG. 6, heat-resistant gasket 172 is shown captured between rear panel 34 and rim 170. A screw fastener 194 extends through aligned holes 171 and 181 (FIG. 5) in rim 170 and rear panel 34, respectively, to pierce gasket 172 and to secure rim 170 to rear panel 34 with gasket 172 in compressive contact therebetween.

Figure 8:
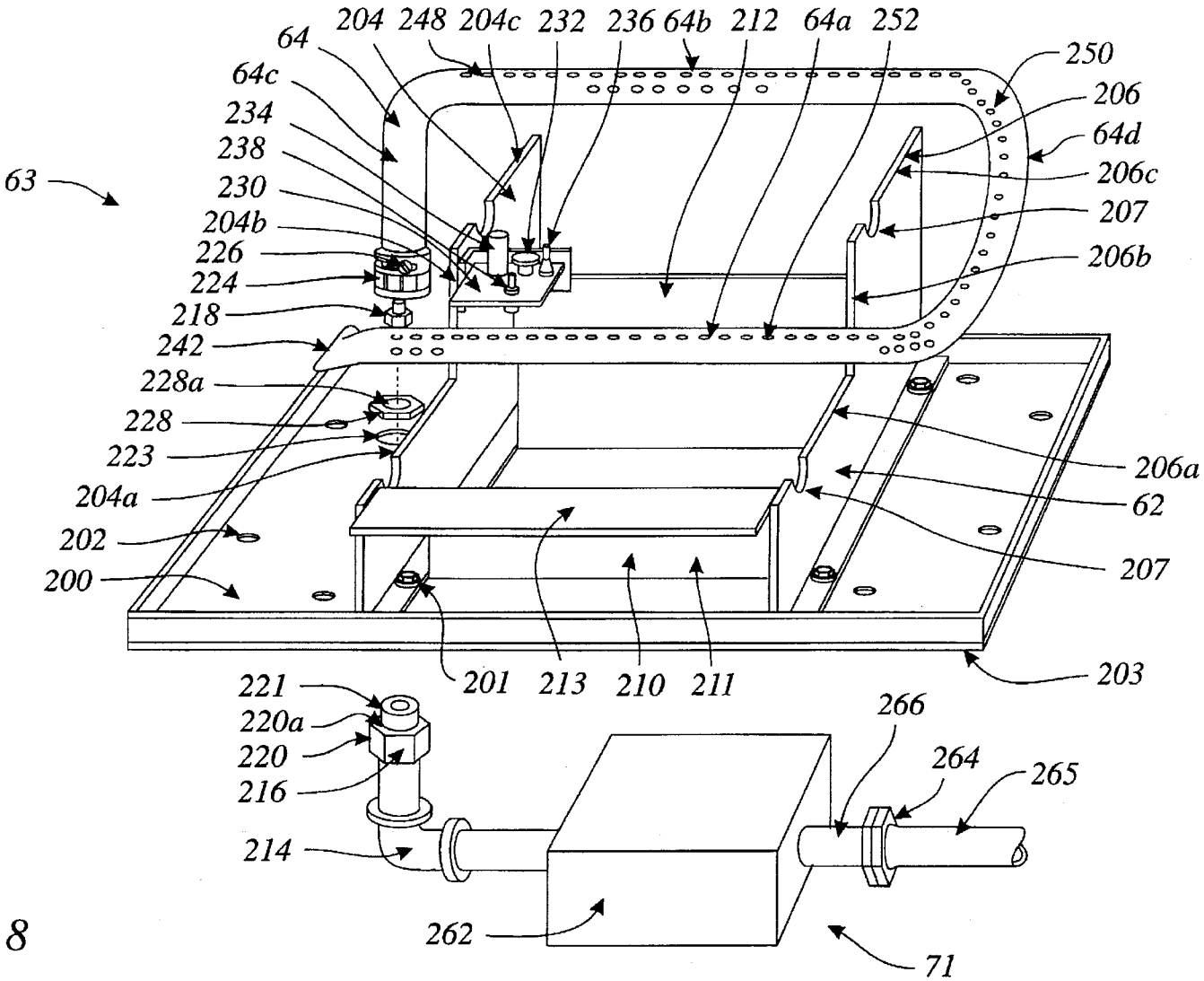
FIG. 8 is a perspective view of a combustion air-intake module of the fireplace assembly of FIG. 3.
Figure 9:
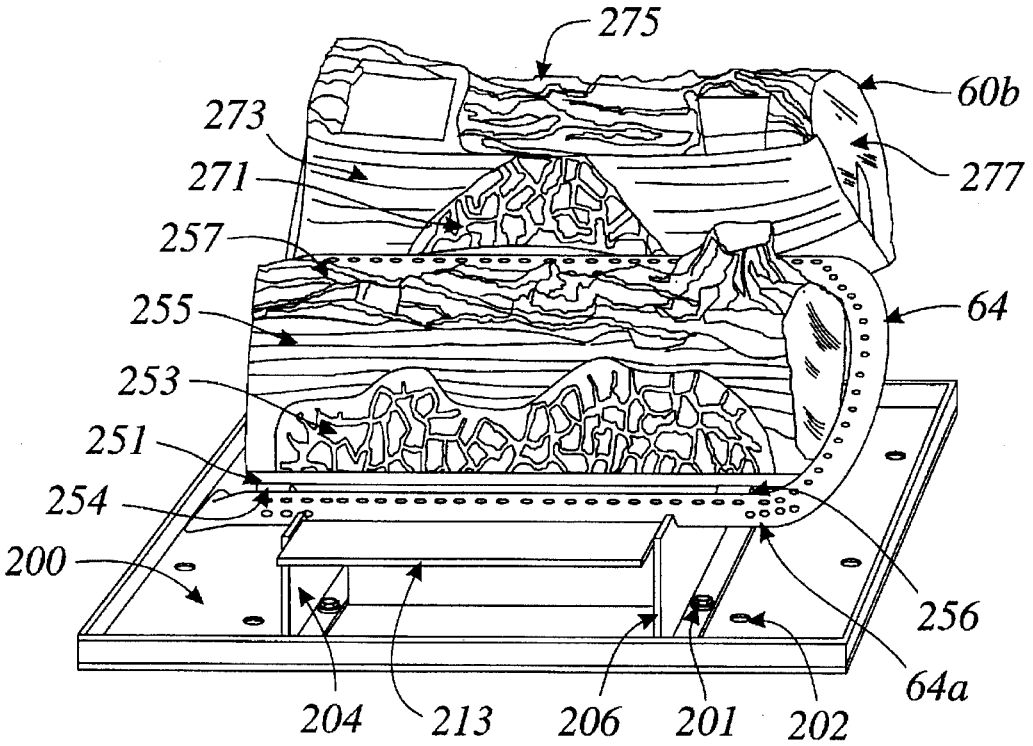
FIG. 9 is a perspective view of a burner module of the fireplace assembly of FIG. 1, showing two artificial logs supported thereon.

Referring now to FIGS. 5 and 8, burner module 63 includes support member 62, burner tube 64 and a rectangular mounting plate 200, which is adapted to cover hole 168 in the bottom of firebox 14. Support member 62 is fastened to mounting plate 200 with screws 201. Plate 200 has a plurality of fastener-receiving holes 202 adapted for alignment with holes 169 in panel 28 when plate 200 is positioned to cover opening 168. A heat resistant gasket 203 is affixed to the underside of plate 200. Fasteners (not shown) are inserted through holes 169, traversing gasket 203, and through aligned holes 202 to secure plate 200 to panel 28, thereby covering opening 168, compressing gasket 203, and sealing the bottom of the firebox 14. Support member 62 includes two generally L-shaped uprights 204 and 206. Each upright 204, 206 has two notches 207 to accommodate the front and rear horizontal burner tubes runs 64*a* and 64*b*. Vertical front and rear flow stabilizers 210 and 212, respectively, extend laterally between uprights 204 and 206.

A burner supply pipe 214 has a customized end fitting 216 for receiving a threaded orifice 218 in mating engagement.

End fitting 216 has an externally threaded upstream male end in mating engagement with burner supply pipe 214. Adjacent to the upstream male end is a long hexagonal section 220, in reality a fixed nut, suited to be grasped by a wrench. Downstream of hexagonal section 220 is a section 221 threaded both externally and internally. It is fed through a clearance hole 223 in mounting plate 200. A downstream shoulder 220*a* of nut 220 locates against the underside of mounting plate 200. A threaded locking nut 228 is then threaded down on the external threads of section 221 and, in cooperation with hexagonal section 220, clamps against mounting plate 200 in the commonly known manner for installing bulkhead penetration fittings. Orifice 218 is externally threaded to mate with the internal threads of section 221. It may be installed or removed with a single wrench from above plate 200.

The most upstream portion of gas burner tube 64 is a vertical leg 64*c*. When burner tube 64 rests in notches 207, the upstream end of leg 64*c* rests on an upwardly facing shoulder 228*a* of locking nut 228 and receives orifice 218 in mating relationship. A shutter valve 224 surrounds a lower portion of vertical leg 64*c* and sits on shoulder 228*a*. Shutter valve 224 includes a valve securing screw 226. In operation the flow of gas through orifice 218 past shutter valve 224 acts as a venturi or injector pump to entrain primary combustion air into the burner tube 64 to mix with the gas fuel (e.g., natural gas or propane). Even when shutter valve 224 is in a closed position, it leaks some primary air into burner tube 64. The use of such a shutter valve is well known. At sea level, shutter valve 224 is in its least open position. At higher altitudes, shutter valve 224 must be opened farther to maintain the same mass flow ratio of gas to combustion air. The position of shutter valve 224 is set on installation by tightening screw 226.

A pilot assembly bracket 230 is attached by screws to upright 204. Mounted to pilot assembly bracket 230 is a pilot 232 coupled to gas control module 71 by means of a pilot gas fuel line (not shown). Also mounted on bracket 230 are a thermocouple 234, a piezo ignition electrode 236 and a thermopile 238, all of which are electrically coupled to control module 71.

Intermediate front and rear horizontal tube runs 64*a* and 64*b* is a U-shaped tube section 64*d*. Front horizontal tube run 64*a* is located in front of and below rear horizontal tube run 64*b* and terminates in a crimped end 242. Rear horizontal tube run 64*b* has a predetermined pattern of apertures 248 from which gas emanates and is burned to form a predetermined flame pattern. The pattern of apertures 248 and the geometry of each aperture are selected to yield a gas jet outflow velocity of approximately 25 feet per second for producing a steady flame. U-shaped tube section 64*d* has a line of apertures 250, which carry the flame from rear horizontal tube run 64*b* to front horizontal tube run 64*a*. Front horizontal tube run 64*a* also has a predetermined pattern of apertures 252 for producing a specific flame pattern. The pitch and diameter of apertures 248 and 252, as well as the respective locations of the individual apertures 248, 252, may be altered to produce any desired flame pattern without the use of flame deflector plates. In the preferred embodiment aperture diameter is 0.055 inches.

Referring to FIGS. 1, 8, 9, 10 and 11, five wood-simulating fireplace logs 60*a*–60*e* made of soft ceramic material are positionable on support member 62. A Front log 60*a* has two slots (not shown) on a lower portion thereof for locating front log 60*a* on respective lower levels 204*a* and 206*a* of uprights 204 and 206, such that front log 60*a* is supported by and extends laterally beyond each upright 204, 206. Front log 60*a* is located behind and in partially overhanging relationship with front horizontal tube run 64*a*. Front log 60*a* has two lugs 254 and 256 in contact with tube run 64*a*. With lugs 254 and 256 so engaged, a rear portion of log 60*a* is forced against forward facing edges 204*b* and 206*b* of uprights 204 and 206, respectively. Front log 60*a* has a bevelled lower front portion 251, a "charred" area 253 (i.e., simulating charred wood) above lower front portion 251, a "split wood" portion 255 (i.e., simulating split wood) above charred area 253 and a "bark" portion 257 (i.e., simulating wood bark) defining the top of log 60*a*. Lugs 254 and 256 maintain approximately a 7/16 inch (plus or minus 1/16 inch) spacing between lower front portion 251 and tube run 64*a* along the length of tube run 64*a*.

Figure 11:
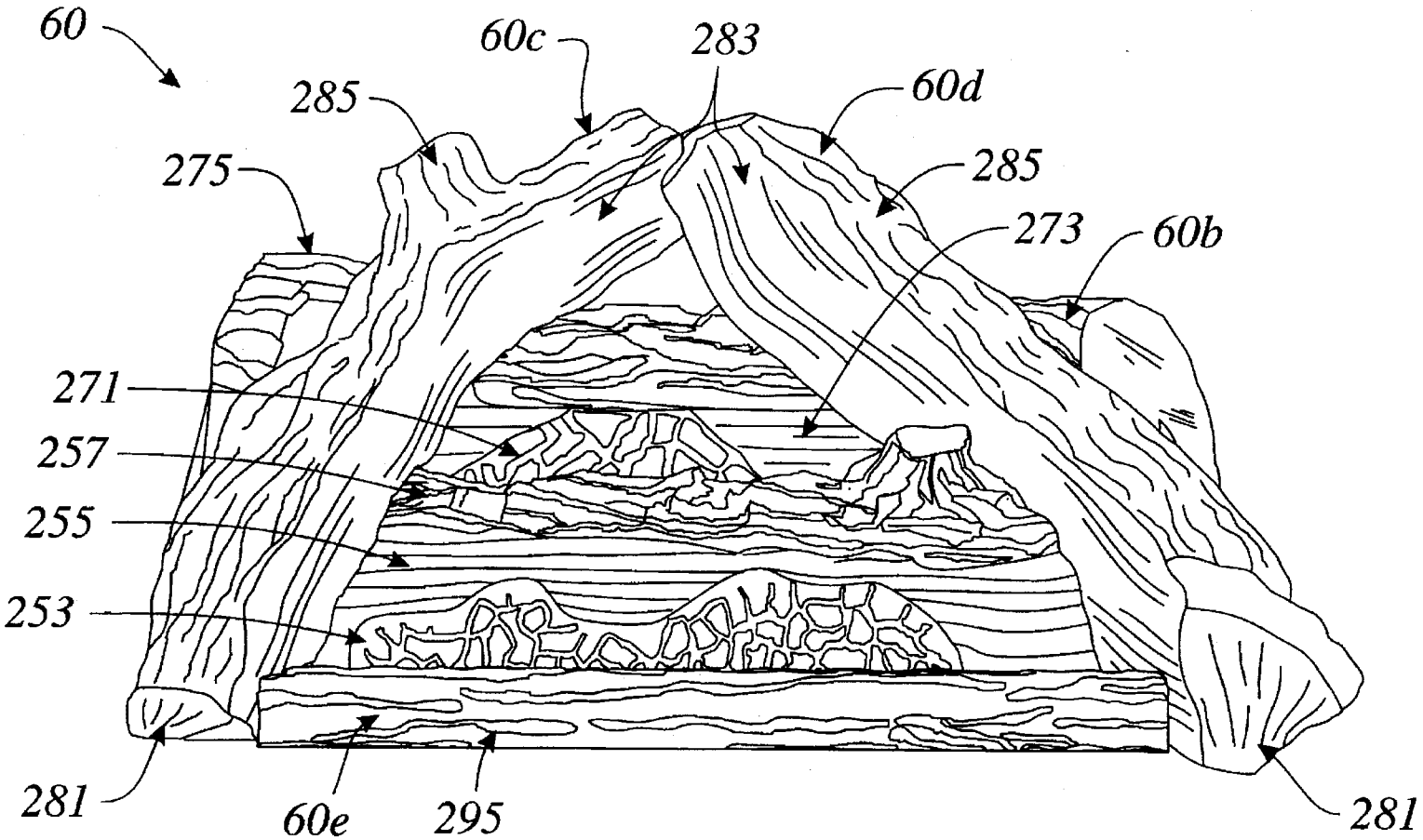
FIG. 11 is a detailed front view of the interior of the firebox of FIG. 3, showing the respective positions of five artificial logs.

A Rear log 60*b* also has two slots (not shown) on a lower portion thereof for locating log 60*b* on respective upper portions 204*c* and 206*c* of uprights 204 and 206. Rear log 60*b* is also supported by and extends laterally beyond each upright 204, 206. Log 60*b* has a bevelled lower front portion 260 and two rear lugs 261. Rear log 60*b* has a "charred" area 271 and a "split wood" portion 273 above lower front portion 260. The top of log 60*b* is defined by a "bark" portion 275. The ends 277 of log 60*b* simulate wood saw cuts. Lower front portion 260 is positionable in contact with rear horizontal tube run 64*b* such that log 60*b* is disposed in partially overhanging relationship with rear horizontal tube run 64*b*. Lugs 261 locate log 60*b* against rear panel 34 of firebox 14. As shown in FIG. 11, a log 60*c* is oriented to run upwardly and inwardly across front log 60*a* and rear log 60*b*. Similarly a log 60*d* is oriented to run upwardly and inwardly across front log 60*a* and rear log 60*b*, such that log 60*c* and 60*d* converge at their respective upper ends. Logs 60*c* and 60*d* each have simulated "saw cut" ends 281, "split wood" portions 283 and "bark" portions 285.

The stability of the flame profiles is enhanced by front and rear flame stabilizers 210 and 212, respectively, formed from the uneven legs of a channel section 211. Front flame stabilizer 210 terminates in a substantially horizontal shelf 213 folded toward lip 174. Shelf 213 is substantially co-planar to, but in spaced parallel relationship with, lip 174.

Figure 10:
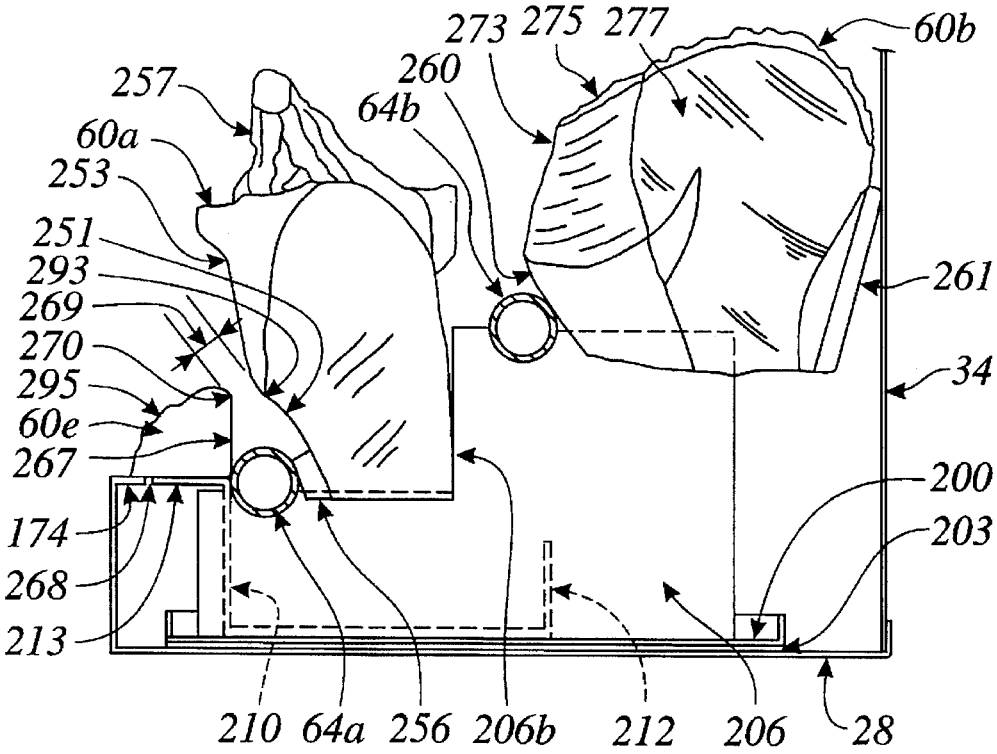
FIG. 10 is an end view of the burner module of FIG. 9 with two artificial logs supported thereon.

Shelf 213 and lip 174 serve to support a quarter log, or ember strip 60*e*. Ember strip 60*e* is provided with locating lugs (not shown), which seat outside uprights 204 and 206, respectively. The relationship of the lugs to uprights 204 and 206 prevents ember strip 60*e* from moving laterally with respect to other parts of the log set and burner assembly 15. Ember strip 60*e* has a substantially vertical rear surface 267 and a substantially horizontal bottom surface 268. The line of the bottom rear corner defined by the intersection of the rear and bottom surfaces 267 and 268, respectively, of ember strip 60*e* abuts front horizontal tube run 64*a*, as shown in FIG. 10. In the preferred embodiment, the clearance dimension shown as 269 in FIG. 10 between the upper back portion 270 of ember strip 60*e* and front log 60*a* at approximately a lower char line 293 (i.e., line of demarcation between lower front portion 251 and charred area 253) is on average ½ inch along the length of ember strip 60*e* plus or minus ⅛ inch at any given point. Ember strip 60*e* has a curved surface 295 with the appearance of wood bark defining the front and top of ember strip 60*e*. All of the logs 60 are made of material which glows when heated. Ember strip 60*e* simulates embers in a real wood fire. Logs 60 are preferably wood-simulating logs of the type sold by Specialty Ceramics Inc. of Salem, Ohio.

Logs 60 are formed and colored to have the appearance of sawn and split logs in a wood fire. As can be best seen in FIG. 10, the flame pattern from front horizontal tube run 64*a* impinges obliquely on lower front portion 251 and then follows the contour of log 60*a* upwardly through clearance 269 in the manner of a real wood fire. The flame pattern from rear horizontal tube run 64*b* impinges obliquely on lower front portion 260 of rear log 60*b* and then follows the contour of rear log 60*b* upwardly also in the manner of a real wood fire. The stability of the flame profiles is enhanced by front and rear flow stabilizers 210 and 212, (and by baffles 66, 192), which maintain a flow of secondary air across horizontal tube runs 64*a* and 64*b* to provide a substantially steady, generally vertical air flow, thereby stabilizing the flame pattern and cooling the burner tube.

Gas control module 71 is installed below plate 200 in air wipe 67. Module 71 is comprised of a housing 262, the rear portion of which may be supported by a shelf (not shown). A coupling 264 connects an inlet pipe 266 to a gas supply conduit 265. Inlet pipe 266 communicates with a gas control valve (not shown) inside housing 262. Burner supply pipe 214 communicates with the gas control valve inside housing 262, such that housing 262 is intermediate pipes 214 and 266. Burner supply pipe 214 terminates at end fitting 216. Coupling 264 is preferably a conventional threaded union coupling. By disengaging pipe coupling 264 and locking nut 228, and the electrical connections to pilot 232, thermocouple 234, piezo ignition electrode 236 and thermopile 238, gas control module 71, together with pipes 214 and 266, end fitting 216 and orifice 218, is removable for servicing without having to remove any other component, except that viewing panel 56 (FIG. 3) must be removed for access to locking nut 228. Control module 71 is easily re-installed by aligning inlet pipe 266 with gas supply conduit 265 and inserting customized end fitting 216 through mounting plate 200 and then re-attaching the aforementioned connections. At least the bottom louver (not shown) through which room air flows into air wipe 67 (FIG. 2) is preferably hinged to give access to control module 71 and pipe coupling 264.

When fireplace assembly 10 is not in operation, the gas control valve inside module 71 is closed to prevent gas from flowing into burner tube 64. When fireplace assembly 10 is in operation, the gas control valve allows gas to flow through supply pipe 214, orifice 218 and vertical leg 64*c* into rear horizontal tube run 64*b*. Pilot 232 ignites the gas emanating from apertures 248 to produce a desired flame pattern on rear log 60*b*. The flame is transferred to front horizontal tube run 64*a* by apertures 250 and the gas emanating from apertures 252 is burned to produce a desired flame pattern on front log 60*a*. Room air flows into air wipe 67 through the bottom louver and around the outside of firebox 14 to pick up heat therefrom. The warmed air rises in air wipe 67 due to its own buoyancy and exits via the top louver back into the room. A blower (not shown) may be installed in air wipe 67 to enhance circulation of air through air wipe 67.

Combustion air entering firebox 14 through tubes 110 flows across burner tube runs 64*a* and 64*b* to sustain the combustion process. Products of combustion (i.e., exhaust gases) flow upwardly around baffle 66, through opening 27*a* and into stub flue 84. The products of combustion are vented to the outside through inner passageway 102 of the double-walled duct 68. The upward flow of exhaust gases in combustion chamber 58 through passageway 102 creates a counterflow of fresh air from the outside through outer passageway 106 surrounding inner wall 100 of duct 68. The fresh air flows into manifold 78 and is carried therefrom into combustion chamber 58 by the four cylindrical tubes 110, as previously described. User-operable controls for controlling the operation of fireplace assembly 10 are also included, but are not shown in the accompanying drawings. Such controls are of conventional design and form no part of the present invention.

The method of assembly of the sealed combustion gas fireplace assembly 10 of the present invention is as follows. First, the components of the individual modules, namely casing 12, firebox 14, combustion air-intake module 77 and burner module 63, are individually manufactured or purchased and assembled into module sets. Once the individual modules have been assembled, final assembly of the fireplace begins with casing 12 (including adaptor 70). Casing 12 is set in place (e.g., in an enclosure adjacent a room with the open front of casing 12 facing the room, and connected to a suitable venting means, such as double walled co-axial duct 68). Combustion air-intake module 77 is fastened to casing 12 from the inside with screws as described hereinabove, such that module 77 is suspended from casing 12. With viewing panel 56 removed, firebox 14 is located within casing 12 as described hereinabove and fastened in place with threaded fasteners through aligned holes 50 and 40, and through aligned holes 51 and 41, whereby firebox 14 is suspended from flanges 36 and 38 of casing 12. The square mounting flange 92 of stub flue 84 is positioned about opening 27*a* and it and baffle 66 are secured to panel 27 with fasteners 96 installed from inside firebox 14. Header member 112 is located to co-operate with clearance holes 114 and corresponding holes in baffle 192. Fasteners 116 are installed from inside the firebox to draw header member 112 forward to compress gasket 118 against panel 34 and join header member 112 to panel 34. The back part of firebox 14 is thereby supported by air-intake module 77. Burner module 63, with control module 71 attached, is then installed in firebox 14 with the logs 60 removed. Plate 200 is fastened in place on bottom panel 28. The gas supply conduit 265 is connected to pipe 266 of control module 71. Logs 60 are placed on uprights 204 and 206. Viewing panel 56 is installed to seal firebox 14.

The gas operated fireplace assembly 10 of the present invention can be shipped and installed as a unitary fireplace after assembly as described hereinabove. Alternatively, it may be shipped as a kit of modules for assembly on site. The modularity of fireplace assembly 10 not only facilitates manufacturing, shipment and installation of fireplace assembly 10, but also facilitates manufacturing, inventory control, shipment and retrofit installation, or upgrading, of spare parts. A basic fireplace assembly kit comprises casing 12, firebox 14, combustion air-intake manifold 77, burner module 63 and logs 60. The choice of balanced flue and cosmetic trim components are optional and do not form part of the basic fireplace assembly kit.

As assembled, structural and thermal conduction loads are transmitted from the firebox 14 to the casing 12 at only three interfaces, i.e., via flanges 36, 38, and 80. A gasket is interposed between the firebox 14 and the casing 12 at the first two of these interfaces, and gaskets and the air-intake module 77 are interposed between the firebox 14 and casing 12 at the third. The limited number of load paths, the use of gaskets, the sliding fitting of stub flue 84, and the non-welded seams of the casing 12 and firebox 14 all help to accommodate thermal expansion of the firebox 14 without excessive noise generation.

Various embodiments of the invention have now been described in detail. Since changes in and/or additions to the above-described best mode may be made without departing from the nature, spirit or scope of the invention, the invention is not to be limited to said details.

We claim:

1. A gas operated fireplace assembly, comprising:

a casing having an open front, said casing being positionable in an enclosure adjacent a room with said open front facing the room;

a firebox having a sealed combustion chamber therein;

mounting means for removably mounting said firebox within said casing such that said firebox is suspended from said casing in spaced relationship therewith to define an air wipe between said firebox and said casing;

a burner module located within said firebox, said burner module being connectible to a combustible gas source for burning combustible gas in said combustion chamber, said air wipe being adapted to allow room air to circulate around said firebox, whereby room air is heated;

a combustion air-intake module in fluid communication between a combustion air source external to the room and said firebox for introducing combustion air into said firebox;

exhaust means for exhausting products of combustion from said combustion chamber;

said casing including a first bottom panel, a first back panel, first and second side panels and a first top panel, said firebox including a second bottom panel, a second back panel, third and fourth side panels and a second top panel, said mounting means including first and second mounting flanges extending inwardly from the respective first and second side panels and third and fourth mounting flanges extending outwardly from the respective third and fourth side panels, said firebox being positioned within said casing with said third mounting flange in facing contact with said first mounting flange and said fourth mounting flange in facing contact with said second mounting flange, said first and third mounting flanges defining a first mounting interface and said second and fourth mounting flanges defining a second mounting interface, said mounting means further including a first fastener removably fastening said third mounting flange to said first mounting flange and a second fastener removably fastening said fourth mounting flange to said second mounting flange, whereby said firebox is suspended from said casing at said first and second mounting interfaces, said mounting means further including means removably fastening one end of said air-intake module to an inner surface of said first top panel, whereby said air-intake module is suspended from said first top panel at a third mounting interface within said air wipe, said mounting means further including means removably fastening an opposite end of said air-intake module to an outer surface of said second back panel at a fourth mounting interface, whereby said firebox is suspended from said air-intake module at said fourth mounting interface.

2. A gas operated fireplace assembly, comprising:

a casing having an open front, said casing being positionable in an enclosure adjacent a room with said open front facing the room;

a firebox removably mounted within said casing and in spaced relationship therewith to define an air wipe between said firebox and said casing, said firebox having a sealed combustion chamber therein;

a burner module located within said firebox, said burner module being connectible to a combustible gas source for burning combustible gas in said combustion chamber, said air wipe being adapted to allow room air to circulate around said firebox, whereby room air is heated;

a combustion air-intake module in fluid communication between a combustion air source external to the room and said firebox for introducing combustion air into said firebox;

exhaust means for exhausting products of combustion from said combustion chamber;

said casing including a first bottom panel, a first back panel, first and second side panels and a first top panel, said firebox including a second bottom panel, a second back panel, third and fourth side panels and a second top panel, respective portions of said first and second top panels being in generally parallel relationship and having a downward slope toward the respective first and second back panels of approximately 25° relative to a horizontal plane parallel to the respective first and second bottom panels;

said combustion air-intake module including an air-intake manifold and a combustion air passageway communicating between said manifold and said combustion chamber for introducing combustion air into said firebox, said exhaust means including a stub flue having a first end mounted with said firebox in fluid communication with said combustion chamber, said stub flue traversing said air wipe and said manifold and extending outwardly from said casing, said stub flue having a second end, opposite from said first end, adapted for engagement with an exhaust duct external to said casing;

said casing, said firebox and said manifold having respective first, second and third openings in concentric relationship, said third opening being intermediate said first and second openings, said first opening being located in the downwardly sloped portion of said first top panel, said second opening being located in the downwardly sloped portion of said second top panel, said third opening being located in a surface of said manifold which is in generally parallel relationship with the downwardly sloped portions of said first and second top panels, said manifold being suspended from an inner surface of said casing, said first end of said stub flue being mounted on an outer surface of said firebox about said second opening and in fluid communication with said combustion chamber through said second opening, said stub flue extending through said third and first openings, said manifold having resilient means for engaging an outer surface of said stub flue to seal said third opening and allow said stub flue to move relative to said manifold.

3. The fireplace assembly of claim 2 wherein said air-intake module further includes a header member having a plurality of first holes and said combustion air passageway includes a plurality of cylindrical tubes in parallel array communicating between said air-intake manifold and said header member, said firebox having a plurality of second holes, said header member being mounted with said second back panel such that said first holes are aligned with respective ones of said second holes, each of said tubes extending through an aligned pair of first and second holes into said firebox.

4. A gas operated fireplace assembly, comprising:

a casing having an open front, said casing being positionable in an enclosure adjacent a room with said open front facing the room;

a firebox removably mounted within said casing and in spaced relationship therewith to define an air wipe between said firebox and said casing;

a burner module located within said firebox, said burner module being connectible to a combustible gas source for burning combustible gas in said combustion chamber, said air wipe being adapted to allow room air to circulate around said firebox, whereby room air is heated;

a combustion air-intake module in fluid communication between a combustion air source external to the room and said firebox for introducing combustion air into said firebox;

exhaust means for exhausting products of combustion from said combustion chamber;

said firebox being comprised of:

a top member having a first panel and a first rim depending from said first panel;

an intermediate member having generally opposed second and third panels and a fourth panel extending between said second and third panels;

a bottom member having a fifth panel and a second rim extending upwardly from said fifth panel;

first fastener means for removably fastening said first rim to respective upper portions of said second, third and fourth panels with said first rim surrounding said respective upper portions of said second, third and fourth panels, whereby said top member is removably joined to said intermediate member; and second fastener means for removably fastening said second rim to respective lower portions of said second, third and fourth panels with said second rim surrounding said respective lower portions of said second, third and fourth panels, whereby said bottom member is removably joined to said intermediate member, said first panel defining a top panel of said firebox, said second and third panels defining respective side panels of said firebox, said fourth panel defining a back panel of said firebox, said fifth panel defining a bottom panel of said firebox;

sealing means for sealing said firebox to provide a sealed combustion chamber therein.

5. The fireplace assembly of claim 4 wherein said top member of said firebox is a first top member, said intermediate member of said firebox is a first intermediate member and said bottom member of said firebox is a first bottom member, said casing being comprised of:

a second top member having a sixth panel and a third rim depending from said sixth panel;

a second intermediate member having generally opposed seventh and eighth panels and a ninth panel extending between said seventh and eighth panels;

a second bottom member having a tenth panel and a fourth rim extending upwardly from said tenth panel;

third fastener means for removably fastening said third rim to respective upper portions of said sixth, seventh and eighth panels with said third rim surrounding said respective upper portions of said sixth, seventh and eighth panels, whereby said second top member is removably joined to said second intermediate member; and fourth fastener means for removably fastening said fourth rim to respective lower portions of said sixth, seventh and eighth panels with said fourth rim surrounding said respective lower portions of said sixth, seventh and eighth panels, whereby said second bottom member is removably joined to said second intermediate member, said sixth panel defining a top panel of said casing, said seventh and eighth panels defining respective side panels of said casing, said ninth panel defining a back panel of said casing, said tenth panel defining a bottom panel of said casing.

6. The fireplace assembly of claim 4 wherein said first rim has a plurality of first holes spaced at predetermined intervals and said respective upper portions of said second, third and fourth panels have a plurality of second holes spaced at predetermined intervals, each of said first holes being aligned with one of said second holes, said sealing means including a first gasket interposed between said first rim and said respective upper portions of said second, third and fourth panels, said first fastener means including a plurality of removable first fasteners, each of which extends through a corresponding pair of aligned first and second holes to secure said first rim to said respective upper portions with said first gasket in compressive contact therebetween, whereby said top member is removably joined to said intermediate member, said respective lower portions of said second, third and fourth panels having a plurality of third holes spaced at predetermined intervals and said second rim having a plurality of fourth holes spaced at predetermined intervals, each of said fourth holes being aligned with one of said fifth holes, said sealing means further including a second gasket interposed between said second rim and said respective lower portions of said second, third and fourth panels, said second fastener means including a plurality of removable second fasteners, each of which extends through a corresponding pair of aligned third and fourth holes to secure said second rim to said respective lower portions with said second gasket in compressive contact therebetween, whereby said intermediate member is removably joined to said bottom member.

7. The modular fireplace assembly of claim 4 wherein said burner module has a base plate with a plurality of first holes extending therethrough, said fifth panel having an opening adapted to accommodate said burner module and a plurality of second holes surrounding said opening, said burner module being mountable within said firebox with each of said first holes aligned with one of said second holes and said base plate covering said opening, said fireplace assembly kit further including a plurality of removable fasteners, each of which is adapted to extend through an aligned pair of first and second holes for removably fastening said base plate to said fifth panel, whereby said burner module is removably mounted with said firebox.

* * * * *